US006058968A

United States Patent [19]

Carter

[11] Patent Number: 6,058,968

[45] Date of Patent: May 9, 2000

[54] FILLING OF TANKS

[76] Inventor: Rodney Carter, Tanglewood, 13 Hawthorne Avenue, Sawston, Cambridge CB2 4TE, United Kingdom

[21] Appl. No.: 09/051,520

[22] PCT Filed: Oct. 14, 1996

[86] PCT No.: PCT/GB96/02506

§ 371 Date: Apr. 10, 1998

§ 102(e) Date: Apr. 10, 1998

[87] PCT Pub. No.: WO97/14646

PCT Pub. Date: Apr. 24, 1997

[30] Foreign Application Priority Data

Oct. 14, 1995 [GB] United Kingdom ..... 9521087

[51] Int. Cl.[7] ..... B65B 3/04

[52] U.S. Cl. ..... 137/561 A; 137/592; 141/286; 141/383

[58] Field of Search ..... 137/561 A, 590, 137/592; 141/286, 383

[56] References Cited

U.S. PATENT DOCUMENTS

| | | | |
|---|---|---|---|
| 1,385,843 | 7/1921 | Rutherford et al. | 137/592 X |
| 2,123,809 | 7/1938 | Seitz | 137/592 |
| 4,161,963 | 7/1979 | Stevens | 137/592 |
| 4,609,010 | 9/1986 | Watson | 137/592 X |
| 4,643,212 | 2/1987 | Rothrock | 137/592 X |
| 5,065,781 | 11/1991 | Cox | 137/590 X |
| 5,066,393 | 11/1991 | Padera et al. | 137/590 X |
| 5,236,000 | 8/1993 | Kizer | 137/590 X |
| 5,421,383 | 6/1995 | Schmid | 137/592 X |

*Primary Examiner*—John Rivell
*Attorney, Agent, or Firm*—Michael Best & Friedrich LLP

[57] ABSTRACT

Apparatus for the filling of a tank with a volatile liquid includes a delivery pipe having a pair of tubular distribution members hinged to the lower end thereof. The distribution members may hinge between an insertion position where they lie parallel to the axis of the delivery pipe and a deployed position where the members are co-axial but extending normally to the axis of the delivery pipe. When in their insertion position, the distribution members as well as the delivery pipe may be passed through the conventional fill-pipe of the tank, the distribution members then hinging to their deployed position as the lower end of the delivery pipe approaches the bottom of the tank. The delivery pipe is in communication with the interior of the distribution members when the latter are in their deployed position. Holes are formed along the length of each distribution member so that volatile liquid fed down the delivery pipe in the tank is distributed throughout the area of the tank, so minimizing turbulence of liquid already in the tank.

16 Claims, 4 Drawing Sheets

FILLING OF TANKS

BACKGROUND OF THE INVENTION

This invention concerns the handling of volatile liquids. In particular, the invention relates to apparatus for use in the filling of a substantially closed tank with a volatile liquid, and also to methods for filling such a tank. The invention further relates to a tank including a fill-pipe.

Though the present invention is applicable to the handling of a wide variety of volatile liquids, it finds a particular application in the filling of a storage tank with petroleum spirit (petrol) such as a storage tank of a petrol filling station used by motorists. The invention will consequently be described hereinafter solely with reference to such application, though it is to be understood that the invention is not to be regarded as limited to this.

It is well known that there are wet stock losses associated with the storage tanks of a petrol filling station—that is to say, the metered amount of petrol delivered to purchasers is always less than the metered amount of petrol supplied to the storage tank from a road tanker. The losses generally are attributed to the volatility of the petrol and in particular vapour losses during delivery of the petrol to the storage tank, the holding of excessive stocks and a temperature differential between petrol already in a storage tank and petrol delivered from a road tanker—which latter is usually significantly higher than petrol already in the storage tank.

Good site management may minimise losses associated with excessive stock holdings. Little can be done about the delivery of petrol at a higher temperature than petrol already in the tank, since that largely depends upon the ambient temperature. The present invention aims at addressing the losses associated with delivery of the petrol into the storage tank.

A filling station underground storage tank is essentially wholly sealed, except for the required openings to allow the delivery and withdrawal of petrol. There may also be one or more further openings through which telemetry equipment may be inserted into the tank. These openings are normally provided in the lid of a manhole at the top of the tank and precautions have to be taken whenever pipes are to be connected to or disconnected from these openings If the tank is to be opened by removal of the lid, extreme precautions have to be taken to ensure the risk of explosion is minimised—and a filling station may be out of service for perhaps 48 hours in the event that a tank has to be opened.

The delivery of petrol is usually performed by connecting a flexible pipe from a road tanker to a fill-pipe passing through the lid and extending downwardly into the tank. Whenever petrol is delivered, there will be very significant turbulence within the petrol already in the tank, leading to the generation of large quantities of vapour. Moreover, the turbulence of the petrol within the tank has a scouring effect on the walls of the tank, leading to the production of scale which has to be filtered out of the petrol withdrawn from the tank.

SUMMARY OF THE INVENTION

The invention aims at providing apparatus for and methods of reducing the agitation and turbulence consequent upon the filling of a tank with a volatile liquid, so as to reduce the generation of vapour.

According to one aspect of the present invention, there is provided filling apparatus for use in the filling of an essentially closed tank with a volatile liquid, comprising a delivery pipe adapted to be inserted generally vertically through an opening into the tank, and at least one distribution member hingedly connected about a transverse axis to the lower end of the delivery pipe so as to be movable between an insertion position where the or each distribution member extends parallel to the pipe and a deployed position where the or each distribution member extends generally radially away from the pipe, the or each distribution member being in the form of a duct arranged so that when in its deployed position liquid flowing along the delivery pipe may then flow along the duct defined thereby.

According to a second aspect of the present invention, there is provided a method of filling of an essentially closed tank with a volatile liquid using apparatus including a delivery pipe having at least one distribution member hingedly connected about a transverse axis to the lower end of the pipe so as to be movable between an insertion position where the or each distribution member extends parallel to the pipe and a deployed position where the or each distribution member extends generally radially away from the pipe, the or each distribution member being in the form of a duct arranged so that when in its deployed position liquid flowing along the pipe may then flow along the duct, which method comprises the steps of lowering said pipe through an opening in the tank with the or each distribution member in said insertion position until the lower end of the or each distribution member touches the bottom of the tank, continuing to lower the pipe so that the or each distribution member is moved from its insertion position to its deployed position and bears on the bottom of the tank, and then supplying liquid to the delivery pipe so that the liquid flows along the pipe and then into the or each deployed distribution member.

In the present invention, at least one, but preferably a pair of, distribution members are arranged to be deployed at the lower end of a conventional tank fill-pipe, in such a way that flow from the delivery pipe is into the distribution members The flow then enters the main volume of the tank from those distribution members, in such a way that the flow is distributed along the length of the tank, so minimising localised highly turbulent conditions. In turn, this reduces the amount of vapour generated, so that conventional vapour recovery systems associated with petrol storage tanks may serve to recover most, if not all, of the vapour.

Most preferably, there are two distribution members both hinged to the pipe and arranged so that when in their deployed positions, the distribution members are aligned with each other, one to each side of the pipe. Thus, the delivery pipe together with the deployed distribution members will be in the form of an inverted T-pipe. If the filling arrangement for a tank is at one end of the tank rather than generally in the middle of the tank, then a single distribution member may be hinged to the pipe. In this case, the distribution member may be relatively long so as still to distribute flow throughout the tank, but to enable insertion of such a distribution member, it may be formed in several sections, hinged together.

Depending upon the fill-pipe arrangement of the tank with which the apparatus is to be used, the delivery pipe to which the or each distribution member is hinged may be in the form of an elongate delivery pipe to which the flexible pipe from a road-tanker is connected Such a pipe may extend slidingly through a gland in the tank lid, to permit vertical movement of the pipe. Alternatively, a fill-pipe may be fixed in the lid, the delivery pipe being a sliding fit within said fill-pipe. Another possibility is for the delivery pipe to be in the form of a relatively short stub-pipe intended to be connected to the lower end of an existing fill-pipe. In the latter case, the external surface of the stub-pipe may appropriately be configured frictionally to engage the inner wall at the end of the existing fill-pipe. The stub-pipe may have an external shoulder against which the lower end of the fill-pipe may engage.

Each distribution member may be in the form of an elongate channel-shaped duct, arranged with the open side of the channel lowermost when in its said deployed position. Alternatively, each distribution member may be in the form of a tube. In either case, the two distribution members must be of an appropriate cross-sectional shape so that when both members are in their respective insertion positions, the two members together may be slid through the conventional fill-pipe or other opening at the top of the tank.

The turbulence of the petrol delivered to the tank may be reduced by providing a plurality of relatively small holes along the length of each distribution member. The sizes of those holes may vary along the length of the distribution member, in order to optimise flow patterns within the tank. Alternatively, flow modifying members may be fitted to each hole. For example, a mesh may be secured over each hole to promote non-turbulent flow.

The lower end of the delivery pipe may be profiled to minimise leakage between that pipe and the adjacent end of each distribution member, and also to facilitate the flow of petrol from the delivery pipe into each distribution member. In addition, a sleeve may be provided within the lower end of the delivery pipe, which sleeve engages the or each distribution member and defines an annular flow path for air out of the or each distribution member, to vent holes formed through the wall of the delivery pipe.

The end of each distribution member remote from the delivery pipe may be profiled to assist the movement of the member to its deployed position, by engagement with the bottom of the tank If required, a wheel may be mounted at the end of each distribution member, which wheel may run along the bottom of the tank.

It will be appreciated that a liquid distribution arrangement generally as described above may be incorporated in a tank, as a fixed part of the tank. This invention therefore extends to an essentially closed tank for a volatile liquid, which tank includes a fill-pipe extending generally vertically into the tank through an opening in an upper part thereof, and a distribution member secured to the lower end of the fill-pipe so as to extend generally radially away from the fill-pipe, the distribution member being in the form or a duct which is in communication with the interior of the fill-pipe so that liquid flowing along the fill-pipe may then flow along the duct defined by the distribution member.

BRIEF DESCRIPTION OF THE DRAWINGS

By way of example only, one specific embodiment of the present invention will now be described in detail, reference being made to the accompanying drawings in which.

DESCRIPTION OF THE PREFERRED EMBODIMENT

Figure 1:
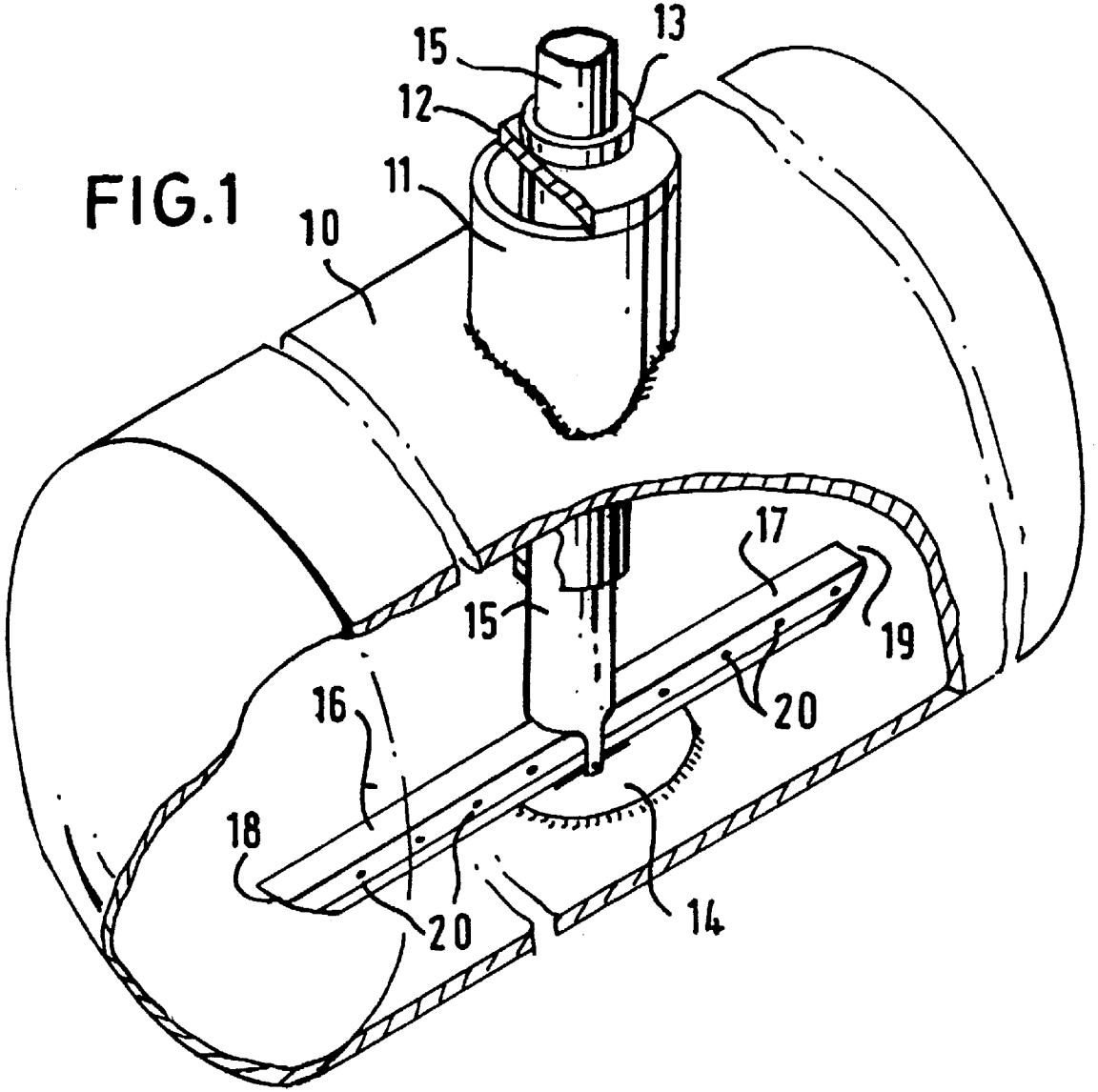
FIG. 1 is a diagrammatic perspective view of an underground petrol storage tank, fitted with an embodiment of filling apparatus of this invention.

In FIG. 1, there is shown somewhat diagrammatically both as to the arrangements and the proportions of the components an underground petrol storage tank 10 of cylindrical shape, and arranged with its axis horizontal. The tank has a circular upstand 11 defining a manhole, which manhole is covered by a lid 12 secured with a ring of bolts (not shown). Fitted into the lid 12 is a conventional fill-pipe 13. Also extending through that lid is a fixed pipe (not shown) for the withdrawal of petrol from the tank, and certain items of telemetry equipment, none of which are shown in the drawings since none relates to the present invention.

The tank 10 is entirely conventional, as is the fill-pipe 13. That fill-pipe usually is welded or otherwise secured to the lid 12, but may be slidable vertically in a sealing manner and may be withdrawn front the tank, in a manner well known in the art. At the bottom of the tank, below the fill-pipe 13, there is a striker plate 14 in order to prevent damage to the tank in the event that a measuring dip-stick is lowered too quickly and hits the bottom of the tank.

The filling apparatus of this invention shown in FIG. 1 comprises a delivery pipe 15 adapted to be a sliding fit within fill-pipe 13. At the lower end 16 of the delivery pipe 15 are provided two arms 16 and 17, hinged to the delivery pipe 15 in order that the arms may swing between a deployed position shown in FIG. 1, where the arms are linearly aligned, to a insertion position (not shown in FIG. 1) where the arms lie alongside each other. The configuration is such that when in their insertion position, the arms may slide through the fill-pipe 13, whereby the apparatus may be inserted into the tank through the fill-pipe 13, and when a filling operation has been completed, the delivery pipe 15 and the arms hinged thereto may be withdrawn from the tank.

The free ends 18 and 19 of the arms 16 and 17 respectively are given a rounded profile as shown in FIG. 1, in order to facilitate insertion of the apparatus into a tank. Thus, on feeding the arms and the delivery pipe into the fill-pipe 13, the free ends 18 and 19 of the arms hit the striker plate 14 and the arms are guided thereby to swing from their insertion position to their deployed position.

Each distribution arm 16 and 17 is formed with a plurality of holes 20 along its length. The size of the holes may vary along the length of each arm and typically the holes nearer the delivery pipe 15 will be significantly smaller than the holes nearer the free ends of the arms. Alternatively, or possibly additionally, the hole spacing may be greater nearer the delivery pipe 15 than further from that pipe.

In order to obtain minimal turbulence of flow, various measures may be taken in order to ensure the flow out of the holes 20 is as smooth as possible. One such possibility is to provide a mesh inside each arm which mesh overlies the holes. Such a mesh is shown at 21, in FIGS. 3 and 4.

Referring now to FIGS. 2 to 6, there is shown a modification of the embodiment of FIG. 1, but which utilises essentially the same principles. The same reference characters are used to identify components corresponding to those of FIG. 1 and those components will not be described again here.

Figure 2:
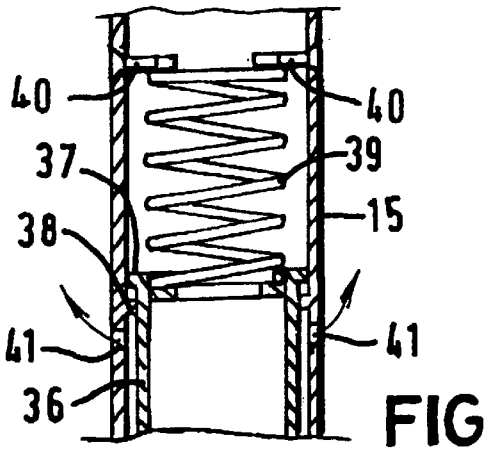
FIG. 2 is an enlarged side view, partly in section, of a modified form of the embodiment of the filling apparatus shown in FIG. 1.
Figure 3B:
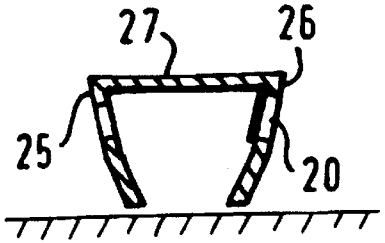
FIG. 3B is a similar cross-sectional view to that shown in FIG. 3, but instead showing a channel shaped arm member with the open side facing the bottom of the tank.
Figure 3:
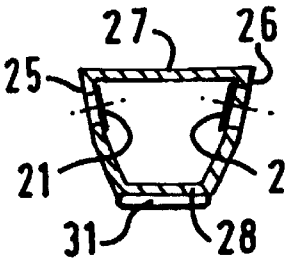
FIG. 3 is a cross-Sectional view taken on line III—III marked on FIG. 2.
Figure 4:
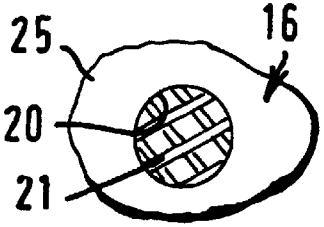
FIG. 4 is an enlarged side view on one of the distribution holes of the filling apparatus.

In FIG. 2, the arms 16 and 17 have a six sided cross-sectional profile, as best seen in FIG. 3. Holes 20 are formed in the opposed upper side surfaces 25 and 26 of the profile. The top and bottom surfaces 27 and 28 of the profile are flat, with the bottom surface 28 significantly narrower than the top surface 27. Elongate strips of mesh 20 may be tack-welded to the inside of the upper side surfaces 25 and 26, as shown in FIG. 3, or individual pieces of mesh may be tack-welded over each hole 20. This latter arrangement has the advantage that different meshes may be employed over the holes nearer the delivery pipe 15, as compared to the holes further from the delivery pipe.

In FIG. 3B the arm is channel shaped with the open face of the channel facing the bottom surface of the tank. Liquid leaves the duct by passing out between the lower edges of the side surfaces 25 and 26 and the tank wall.

The free end of each arm 16 and 17 is provided with a jockey wheel 29 on a strut 30 protecting from the respective free end. The jockey wheel 29 serves to facilitate the movement of the respective arm from its insertion position to its deployed position, as the delivery pipe 15 is slid into the tank, through fill-pipe 13. Once the angle between the delivery pipe 15 and the respective arm has increased to a sufficient extent, the wheel 29 will come clear of the bottom of the tank and the lower surface of the arm will slide directly on the bottom of the tank. To minimise wear, a pad 31 is attached to the underside of each arm, adjacent the free end thereof.

Also shown in FIG. 2 is the hinge arrangement between the arms 16 and 17 and the lower end of the delivery pipe 15 Each arm has a respective hinge plate 32 attached to the bottom surface 28, the two hinge plates being formed much like a conventional butt hinge, with the hinge pin 33 also extending through aligned holes formed diametrically at the bottom of the pipe 15. In this way, the two arms may hinge between the deployed position shown in FIG. 2 and the insertion position where the two arms lie side by side, parallel to one another.

Figure 5:
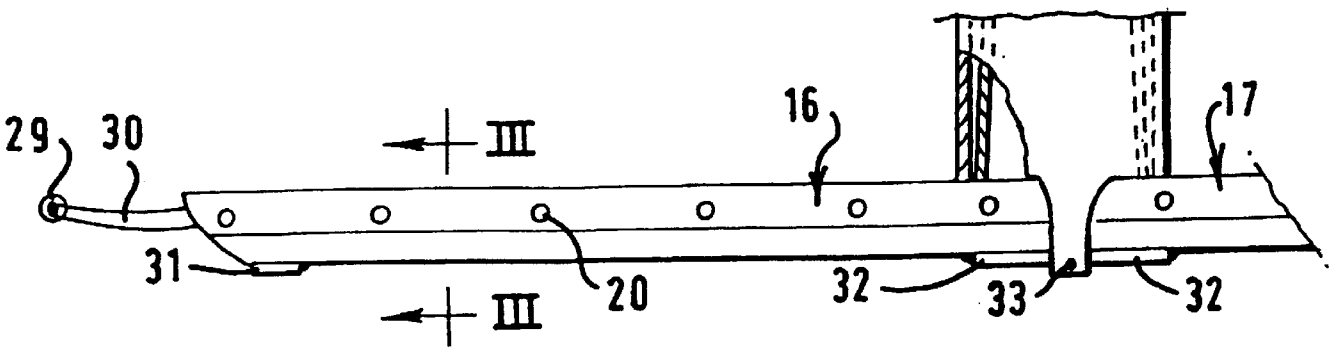
FIG. 5 is a partial plan view on the apparatus of FIG. 2.
Figure 5:
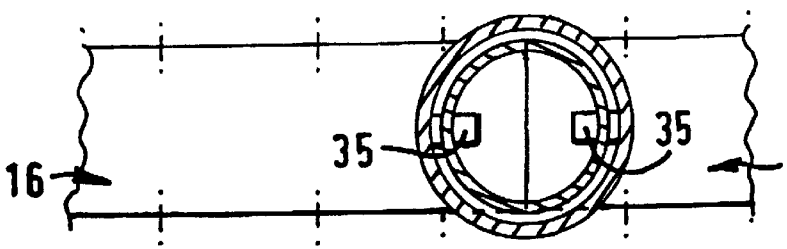
Figure 6:
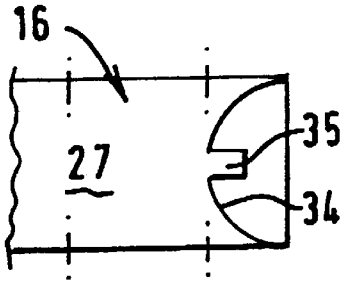
FIG. 6 is a detailed view on the central part of one arm shown in FIG. 5.

In order to allow communication between the interior of pipe 15 and the interior of each arm 16, 17 the top surface 27 of each arm is provided with a semi-circular cut-out 34, though with an inwardly-projecting lug 35 arranged at the mid-point of the arcuate edge of the cut-out, as shown in FIGS. 5 and 6. The radius of the arcuate part of the cut-outs is substantially the same as the radius of the internal wall of delivery pipe 15, so that when the arms are in their deployed position, there is direct communication between the delivery pipe 15 and the arms 16 and 17.

Slidably mounted within the lower end portion of the delivery pipe 15 is a sleeve 36, flaring outwardly slightly, down towards the lower end of the pipe 15 The sleeve 36 has a flange 37 at its upper end which is a free sliding fit within the pipe 15 and which is engageable with a shoulder 38 provided within the pipe 15, below the flange 37. The upper part of the outer surface of the sleeve 36 is a free sliding fit within the shoulder 38. A spring 39 urges the sleeve 36 downwardly, the upper end of the spring 39 bearing on screws 40 threaded into the pipe 15 to project radially inwardly from the wall of the tube. Vent holes 41 are formed in the pipe 15, immediately below shoulder 38

Figure 7:
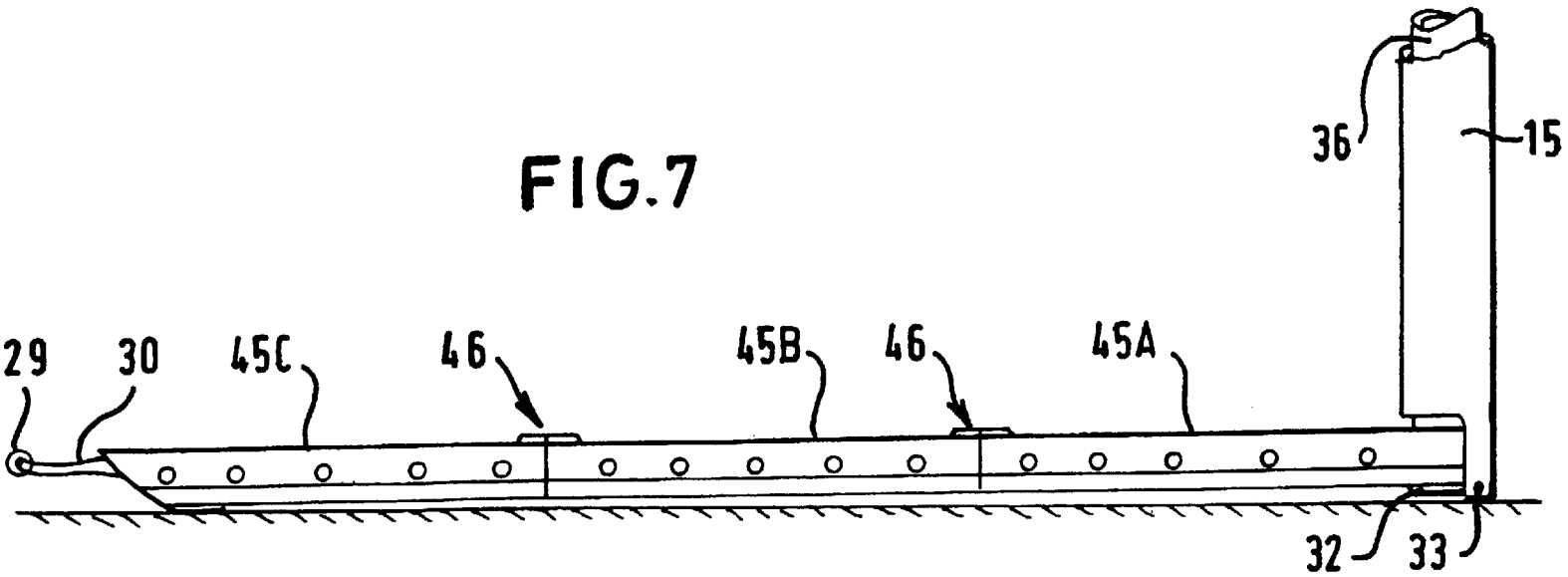
FIG. 7 is a side view of a second embodiment of filling apparatus of this invention.
Figure 8:
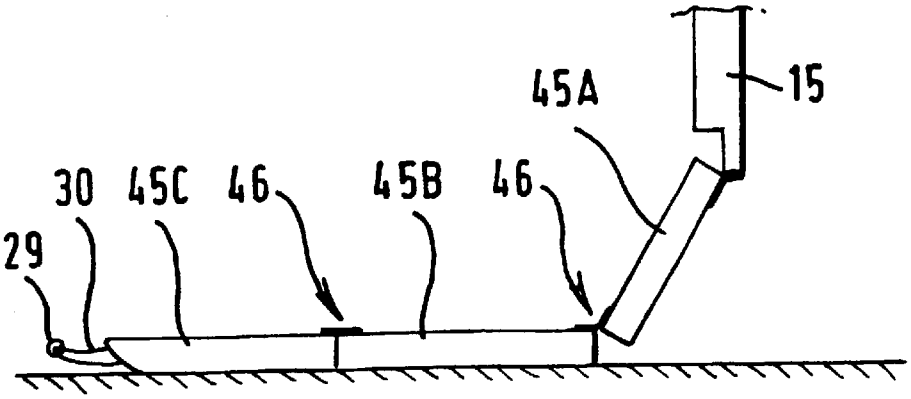
FIG. 8 is a view on the apparatus of FIG. 7, as that apparatus is being inserted into an underground fuel tank.

In use, when the arms 16 and 17 are in their deployed positions, the sleeve 36 is supported by lugs 35. There is however communication between the interior of the arms 16, 17 and the annulus between the external wall of sleeve 36 and the internal wall of pipe 15. Thus, on inserting the assembly into a tank, with the upper end of the delivery pipe 15 closed, air may bleed out of the assembly up the annulus and out of vent holes 41, so obviating the bubbling of the air through fuel already within the tank 10. It will be appreciated that the holes 41 should be provided in pipe 15 at such a position that they are located above the normal maximum fuel level in a tank 10, so as to avoid air bubbling through the fuel. FIGS. 7 and 8 show a second embodiment of filling apparatus of this invention, corresponding generally to the arrangement of FIG. 2 but differing in that only a single arm 45 is provided. This arm is relatively long as compared to the single arms of previous embodiments and so to allow the insertion of this arm into a tank, it is formed in three sections 45A, 45B and 45C, hinged together at 46. Each hinge is provided on the top surface of the arm, as shown particularly in FIG. 8.

As only one arm is provided, the cross-sectional area of that arm may be significantly greater than either of the two arms of the previous embodiments, since in the insertion position where the arm is aligned with delivery pipe 15, the arm does not have to lie alongside a second arm and a greater width arm may be accommodated in fill-pipe 13. In other respects, the arrangement of FIGS. 7 and 8 corresponds to that of FIGS. 2 to 6 and will not be described again here.

Figure 9:
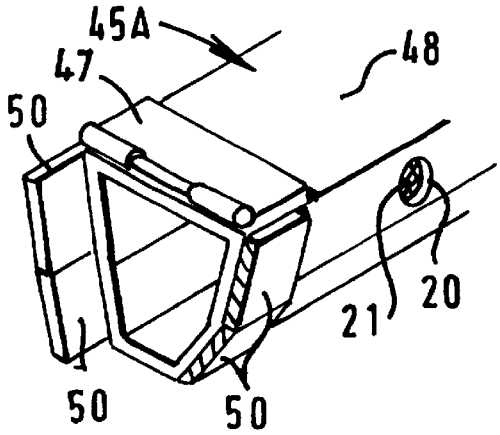
FIG. 9 is a detailed perspective view on an enlarged scale of an connection between two of the arm members shown in FIGS. 7 and 8.

FIG. 9 shows in more detail the end of arm section 454. As can be seen, a hinge plate 47 is attached to the top Surface 48 of the arm section, the hinge plate supporting a hinge pin 49 which is received in a correspondingly formed hinge plate attached to the top surface of the adjacent end of arm section 45B. Guide plates 50 are attached to the outer surfaces of the arm section 45A to relieve strain on the hinge pin 49 and to increase sealing between the adjacent ends of arm sections 45A and 45B. of course, the hinge connection between arm sections 45B and 45C is similarly formed.

Figure 10:
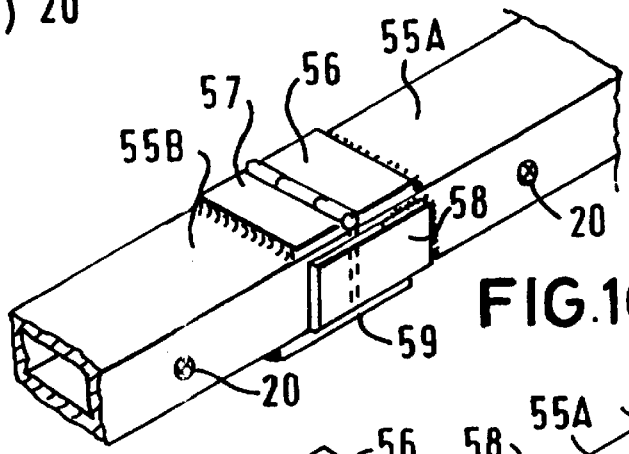
FIG. 10 is a detailed perspective view on an connection between two arm members of a further embodiment.
Figure 11:
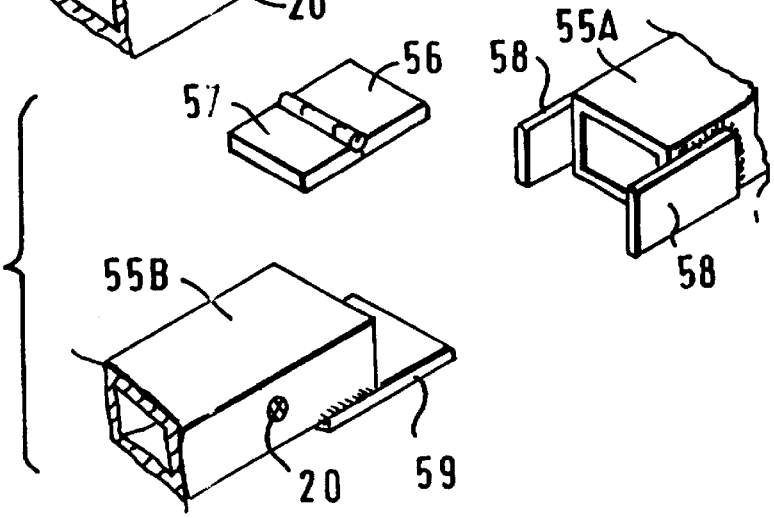
FIG. 11 is an exploded view of the connection of FIG. 10.

FIGS. 10 and 11 show the hinge connection between two differently formed arm sections 55A and 55B, for use in an alternative embodiment of this invention Each arm section 55A and 55B is of rectangular cross-sectional shape and a simple hinge having two hinge plates 56 and 57 is attached for example by welding to the top surfaces of the arm sections. Two guide plates 58 are attached one to each side of arm section 55A so as to project beyond the end of that section. A similar guide plate 59 is attached to the bottom surface of arm section 55B, to project beyond the end of that section. As the arm sections are hinged to bring the two sections co-axial, the guide plates 58 and 59 will serve to keep the two sections in alignment and finally to ensure leakage out of the joint is minimised.

When the filling apparatus of any of the above embodiments is employed to introduce a highly volatile liquid into tank 10, the turbulence of the liquid will be much reduced as compared with the use of a simple vertical fill-pipe as is conventionally employed for example in connection with underground petrol tanks on a filling station forecourt. Consequent upon the much reduced turbulence within the tank, there will be less vapour generation. Most filling stations are provided with vapour recovery systems which are adequate for normal tank operations other than when being filled, but by employing the filling apparatus of the present invention, it is expected that a conventional vapour recovery system will be able to handle the volume of vapour generated even when filling the tank. There is the additional advantage that there will be less scouring of the side walls of the tank, so leading to less scale generation and a reduced need for filter maintenance.

What I claim is:

1. Filling apparatus for use in the filling of an essentially closed tank with a volatile liquid, while minimizing any resultant turbulence in the tank comprising a delivery pipe adapted to be inserted generally vertically through an opening into the tank, and at least one distribution member being hingedly connected about a transverse axis to the lower end of the delivery pipe so as to be movable between an insertion position where the or each distribution member extends parallel to the pipe and a deployed position where the or each distribution member extends generally radially away from the pipe, the or each distribution member being in the form of a duct arranged so that when in its deployed position liquid flowing along the delivery pipe may then flow along the duct defined thereby, and exit from the distribution member along the length thereof.

2. Filling apparatus as claimed in claim 1, wherein the or each distribution member is in the form of an elongate channel-shaped duct, arranged with the open side of the channel lowermost when in its said deployed position.

3. Filling apparatus as claimed in claim 1, wherein the or each distribution member is tubular.

4. Filling apparatus as claimed in claim 1, wherein the or each distribution member has a plurality of distribution holes formed along the length thereof.

5. Filling apparatus as claimed in claim 1, wherein two distribution members are provided which, when in their respective deployed positions, are aligned and lie to each side of the delivery pipe.

6. Filling apparatus as claimed in claim 5, wherein the two distribution members are hingedly connected to the lower end of the delivery pipe about a common transverse axis.

7. Filling apparatus as claimed in claim 1, wherein the lower end of the delivery pipe is configured to form a seal around an opening into the or each deployed distribution member, to facilitate the flow of liquid from said pipe into the or each member.

8. Filling apparatus as claimed in claim 7, wherein a sleeve is provided within the lower end portion of the delivery pipe, which sleeve is arranged to connect to the interior of the or each distribution member, there being vent holes formed through the wall of the delivery pipe below the upper end of the sleeve, whereby air may bleed out of the or each distribution member into the annulus space between the sleeve and the delivery pipe and then out of the vent holes.

9. Filling apparatus as claimed in claim 1, wherein the end of the or each distribution member remote from the pipe is profiled to facilitate the movement of the respective member from its insertion position to its deployed position by engagement with the bottom of the tank upon insertion of the apparatus into a tank.

10. Filling apparatus as claimed in claim 1, wherein a wheel is provided at said remote end of the or each distribution member.

11. A method of filling of an essentially closed tank with a volatile liquid using apparatus including a delivery pipe having at least one distribution member being hingedly connected about a transverse axis to the lower end of the pipe so as to be movable between an insertion position where the or each distribution member extends parallel to the pipe and a deployed position where the or each distribution member extends generally radially away from the pipe, the or each distribution member being in the form of a duct arranged so that when in its deployed position liquid flowing along the pipe may then flow along the duct, which method comprises the steps of lowering said pipe through an opening in the tank with the or each distribution member in said insertion position until the lower end of the or each distribution member touches the bottom of the tank, continuing to lower the pipe so that the or each distribution member is moved from its insertion position to its deployed position and bears on the bottom of the tank, and then supplying liquid to the delivery pipe so that the liquid flows along the pipe and then into the or each deployed distribution member, and exit from the distribution member along the length thereof.

12. An essentially closed tank for a volatile liquid, which tank includes a fill-pipe extending generally vertically into the tank through an opening in an upper part thereof, and a distribution member secured to the lower end of the fill-pipe so as to extend generally radially away from the fill pipe, the distribution member being in the form of a duct which is in communication with the interior of the fill-pipe so that liquid flowing along the fill-pipe may then flow along the duct defined by the distribution member, said member being configured to permit discharge therefrom of liquid supplied thereto from the fill-pipe along the length of the distribution member.

13. A tank as claimed in claim 12, wherein the distribution member extends radially away from the fill-pipe to both sides of the fill-pipe.

14. A tank as claimed in claim 12, wherein the distribution member is in the form of an elongate channel-shaped duct, arranged with the open side of the channel lowermost.

15. A tank as claimed in claim 12, wherein the distribution member is in the form of a tube.

16. A tank as claimed in claim 12, wherein the distribution member has a plurality of distribution holes formed along the length thereof.

* * * * *